US009650188B1

(12) United States Patent
Grabowski et al.

(10) Patent No.: US 9,650,188 B1
(45) Date of Patent: May 16, 2017

(54) DELAYED PIERCE, SEALED CONTAINER

(71) Applicant: HealthStar, Inc., Braintree, MA (US)

(72) Inventors: William J Grabowski, Braintree, MA (US); Peter J DeCoste, Holbrook, MA (US)

(73) Assignee: Healthstar, Inc., Braintree, MA (US)

( * ) Notice: Subject to any disclaimer, the term of this patent is extended or adjusted under 35 U.S.C. 154(b) by 0 days.

(21) Appl. No.: 15/098,653

(22) Filed: Apr. 14, 2016

(51) Int. Cl.

| | |
|---|---|
| ***B65D 47/38*** | (2006.01) |
| ***B65D 1/02*** | (2006.01) |
| ***B65D 1/08*** | (2006.01) |
| ***B65D 17/00*** | (2006.01) |
| ***B65D 41/04*** | (2006.01) |
| ***B65D 41/28*** | (2006.01) |

(52) U.S. Cl.
CPC ..... *B65D 47/38* (2013.01); *B65D 1/0246* (2013.01); *B65D 1/08* (2013.01); *B65D 17/02* (2013.01); *B65D 41/0478* (2013.01); *B65D 41/0485* (2013.01); *B65D 41/28* (2013.01)

(58) Field of Classification Search
CPC ..... B65D 47/38; B65D 47/36; B65D 1/0246; B65D 1/0238; B65D 1/023; B65D 1/08; B65D 17/02; B65D 17/16; B65D 17/168; B65D 17/24; B65D 17/501; B65D 41/0478; B65D 41/0471; B65D 41/0485; B65D 41/04; B65D 41/28; B65D 41/32; B65D 41/3428; B65D 51/002; B65D 51/226; B65D 51/22; B65D 51/20; B65D 39/16
USPC ..... 215/330, 331, 251, 253, 250, 228, 297, 215/296, 295, 329, 316, 44, 43, 247, 249, 215/227; 220/300, 278, 277, 265, 212, 220/254.8, 254.1, 258.3, 258.1, 256.1; 222/153.1, 568, 567, 541.8, 541.7, 541.6, 222/541.2, 541.1; 604/415; 206/0.5, 206/219, 222
See application file for complete search history.

(56) References Cited

U.S. PATENT DOCUMENTS

| | | | |
|---|---|---|---|
| 5,279,576 | A | 1/1994 | Loo et al. |
| 5,427,275 | A | 6/1995 | Hansen |
| 5,772,652 | A | 6/1998 | Zielinski |

(Continued)

FOREIGN PATENT DOCUMENTS

| | | | |
|---|---|---|---|
| EP | 1561698 | A1 | 8/2005 |
| GB | 2263107 | A | 7/1993 |

(Continued)

*Primary Examiner* — Robert J Hicks
(74) *Attorney, Agent, or Firm* — Altman & Martin; Steven K Martin

(57) ABSTRACT

A sealed liquid container with a bottle, base, piercer, and cap. The bottle is a blow-fill-seal container with a body, dispensing head connected to the body by a neck, and a fluid chamber. The base has a socket that accepts the dispensing head and permanently attaches to the bottle by one or more fingers extending radially into the socket and under the shoulder of the dispensing head. A keying mechanism prevents the base from rotating on the bottle. The piercer has an axially-extending, sharpened, hollow tube. In shipping mode, the piercer is turned onto the base until the tube tip is touching the dispensing head. To use, the piercer is turned until the tube tip penetrates the dispensing head into the fluid chamber, and the piercer locking mechanism is engaged to prevent removal of the piercer. A cap turns onto the piercer.

20 Claims, 11 Drawing Sheets

(56) References Cited

U.S. PATENT DOCUMENTS

| | | | | |
|---|---|---|---|---|
| 5,817,082 | A | 10/1998 | Niedospial, Jr. et al. | |
| 6,076,704 | A * | 6/2000 | Weiler | B65D 47/14 222/541.2 |
| 7,886,922 | B2 * | 2/2011 | Seelhofer | B65D 5/748 215/249 |
| 8,225,826 | B2 * | 7/2012 | Horppu | A61J 1/2089 141/22 |
| 2002/0173748 | A1 | 11/2002 | McConnell et al. | |
| 2004/0200855 | A1 | 10/2004 | Weiler | |
| 2006/0108135 | A1 * | 5/2006 | Cho | B65D 51/2835 173/128 |
| 2007/0272703 | A1 * | 11/2007 | Gross | B65D 47/18 222/83 |
| 2008/0223484 | A1 * | 9/2008 | Horppu | A61J 1/2089 141/329 |
| 2009/0020494 | A1 * | 1/2009 | Seelhofer | B65D 5/748 215/252 |
| 2010/0145287 | A1 | 6/2010 | Grevin | |
| 2014/0151322 | A1 | 6/2014 | Bahri et al. | |

FOREIGN PATENT DOCUMENTS

| | | | |
|---|---|---|---|
| WO | 2006/075342 | A1 | 7/2006 |
| WO | 2014/081592 | A1 | 5/2014 |

* cited by examiner

DELAYED PIERCE, SEALED CONTAINER

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to dropper dispensers, more particularly, to sealed dropper dispenser that can be shipped sealed and unsealed by the user.

2. Description of the Related Art

Blow-fill-seal droppers may be produced by a single-piece, piercing cap which creates an imprecise aperture (hole) at the bottle tip. This method results in inconsistent dosage delivery due to uncontrolled aperture diameter and surface area.

Dosage-accurate blow-fill-seal droppers are manufactured by a process called "insertion". Insertion uses a pre-assembled dropper-tip/cap combination which is inserted into the blow-filled-sealed container between the fill and seal stages. This is done utilizing specialized blow-fill-seal machines. The additional process increases cycle time and complexity of the machine and process. Insertion also requires a higher degree of sterility control as the components make contact with the fill solution upon assembly.

BRIEF SUMMARY OF THE INVENTION

The present invention is a sealed liquid container that the end user opens by a self-contained piercing tip that then functions as a metered dropper. The container has a bottle, base, piercer, and cap.

The bottle is a standard blow-fill-seal container and can be formed and filled by any method known in the art. It can have any shape and volume (capacity) desired with several requirements. The bottle has a main body, a dispensing head connected to the body by a neck that forms a shoulder, and fluid chamber that extends between all three. Optionally, the bottle has one or more flat tabs extending radially from the dispensing head for keying. The dispensing head wall opposite the neck must be thin enough to be pierced.

The base connects the bottle and the piercer. The bottle section of the base permanently attaches to the bottle by a base retention mechanism. The bottle section has a socket shaped to accept the dispensing head.

In one form, the base retention mechanism includes at least one finger extending generally radially into the socket. The finger fits under the shoulder of the dispensing head to engage the neck, thereby retaining the base on the bottle. In another form, the bottle section wall has opposed tabs that bend outwardly. The free end of the tab has a finger extending radially into the socket and fits under the shoulder of the dispensing head to engage the neck, thereby retaining the base on the bottle. The base is installed on the bottle by placing the base on the dispensing head and pushed axially until the fingers snap under the shoulder.

Optional radial slots in the bottle section accept the optional tabs of the bottle dispensing head as a keying mechanism to prevent the base from rotating on the bottle. In another keying mechanism, the dispensing head and socket have a non-round shape to prevent the base from rotating on the bottle.

The piercer section of the base has an axial bore in communication with the socket and that receives the piercing tube of the piercer. The piercer section has a detent depression as part of a piercer locking mechanism.

The piercer pierces the bottle and locks onto the base after piercing. The base section of the piercer has a screw thread that mates with a screw thread on the base. A hollow piercing tube extends axially from the piercer beyond the thread far enough to pierce the piercing wall of the bottle.

The piercer is installed by turning the piercer onto the base piercer section thread. In the shipping mode, the piercer is turned until the piercing tube tip is touching or nearly touching the piercing wall. Prior to use, the piercer is turned until the piercing tube tip has penetrated the piercing wall and extends into the fluid chamber, and the piercer can no longer turn. At this point, the piercer locking mechanism is engaged. The piercer locking mechanism can take any form known in the art. In the present design, it is a detent mechanism on the base and piercer. Another variation is similar to the finger/shoulder mechanism described above.

The cap section of the piercer has an axial dispensing bore with an opening. The internal end interfaces with the internal end of the piercing tube to provide drop control.

The cap closes the dispensing bore opening. Optionally, the cap has a plug that fits snuggly into the dispensing bore opening as a stopper. The cap is removably attached to the piercer by threads.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
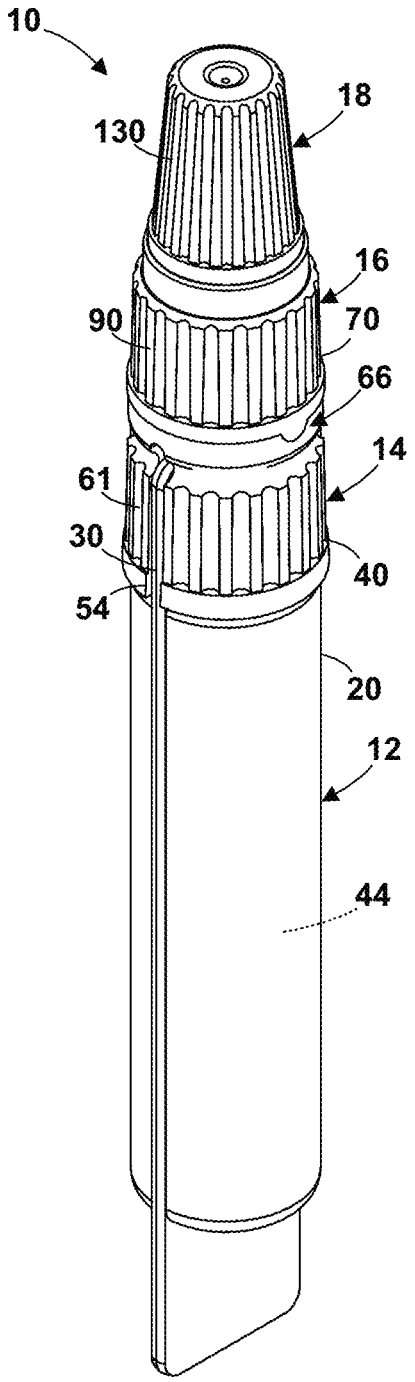
FIG. 1 is a perspective view of one configuration of the container of the present invention.
Figure 2:
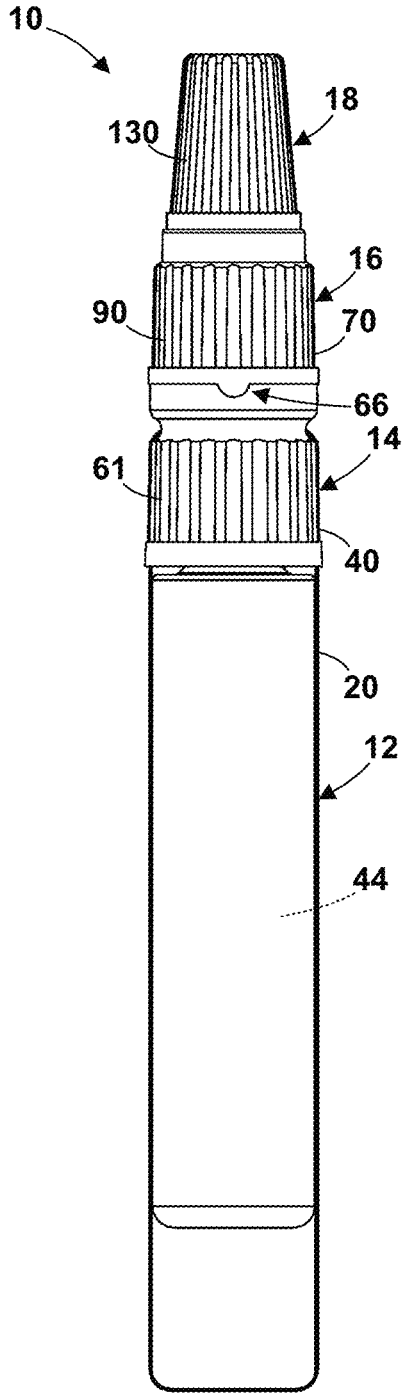
FIG. 2 is a front view of the container of FIG. 1.
Figure 3:
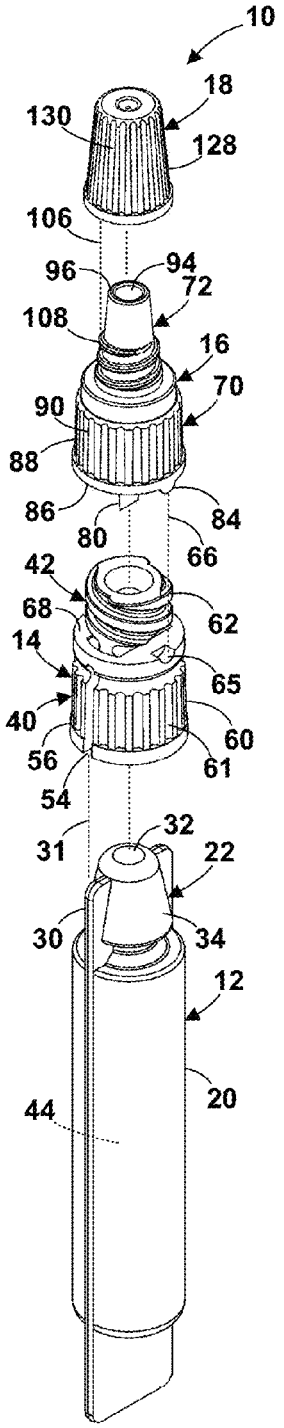
FIG. 3 is exploded, perspective view of the container of FIG. 1.
Figure 4:
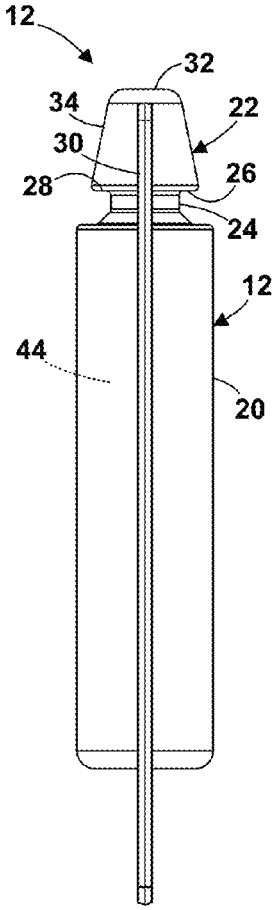
FIG. 4 is a side view of the bottle of FIG. 1.
Figure 5:
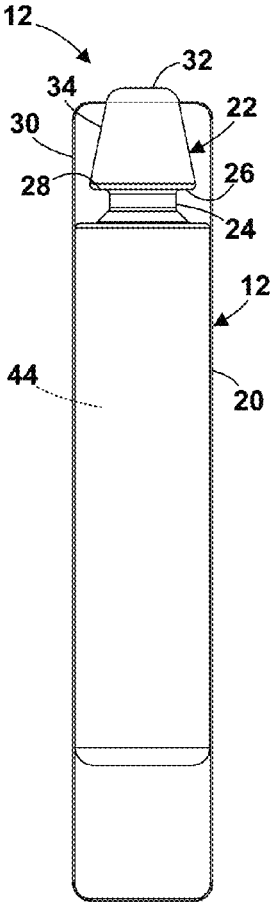
FIG. 5 is a front view of the bottle of FIG. 1.
Figure 6:
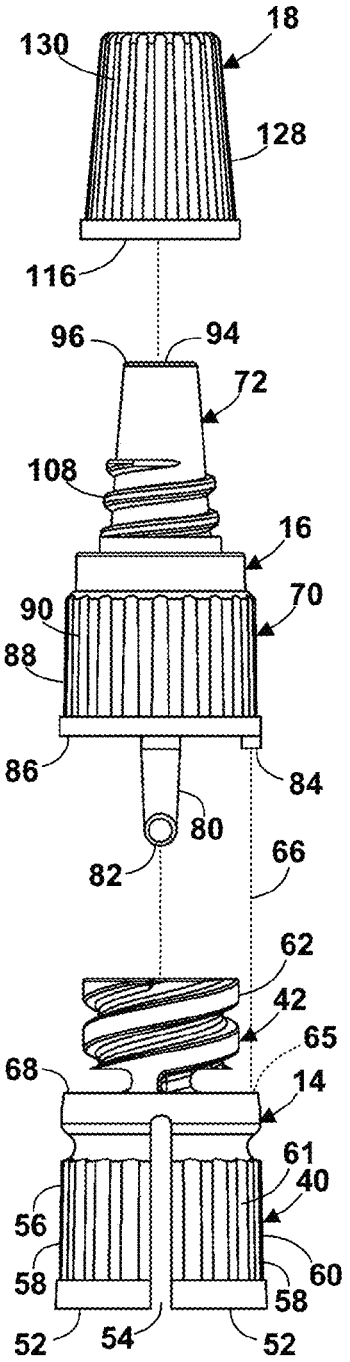
FIG. 6 is a side, exploded view of the base, piercer, and cap of FIG. 1.

The present invention is a sealed liquid container that the end user opens by a self-contained piercing tip. After piercing, the piercing tip functions as a metered dropper and incorporates a threaded neck that receives a screw-on cap to reclose the container. The container 10 consists of four components: the bottle 12, the base 14, the piercer 16, and the cap 18.

The bottle 12 is a standard blow-fill-seal container and can be formed and filled by any method known in the art. Briefly, plastic resin is vertically heat extruded through a circular throat to form a hanging tube called the parison. The parison enclosed within a two-part mold and cut above the mold. The mold is transferred to the sterile filling space, where a mandrel inflates the plastic to form the container within the mold. Following the formation of the container, the mandrel fills the fluid chamber 44 with liquid and a secondary top mold seals the container.

The bottle 12 can have any shape and volume (capacity) desired. The present invention, however, requires that the dispensing end of the bottle 12 have several characteristics.

The bottle 12 has a main body 20 and a dispensing head 22 connected by a neck 24. The fluid chamber 44 extends between all three. The neck 24 forms a shoulder 26 at the inner end 28 of the dispensing head 22. The shoulder 26 is described in more detail below.

Optionally, the bottle 12 has one or more flat tabs 30 extending radially from the dispensing head 22 as part of the keying mechanism 31. The tabs 30 are described in more detail below.

The wall 32 of the dispensing head 22 opposite the neck 24 must be thin enough to be pierced, as described below.

The dispensing head 22 can have any shape when seen from the piercing wall 32. In the figures, the dispensing head 22 is round. The sides 34 of the dispensing head 22 are preferably sloped so that the diameter of the dispensing head 22 is smaller at the piercing wall 32 than at the inner end 28. The sloped sides 34 facilitate installation of the base 14, as described below.

The base 14 provides a connection between the bottle 12 and the piercer 16. The base 14 has two sections, the bottle section 40 and the piercer section 42.

The bottle section 40 is designed to permanently attach to the bottle 12 by a base retention mechanism 50. The bottle section 40 has a socket 46 shaped to accept the dispensing head 22 of the bottle 12. In other words, the bottle dispensing head 22 fits into the base bottle section socket 46.

Figure 7:
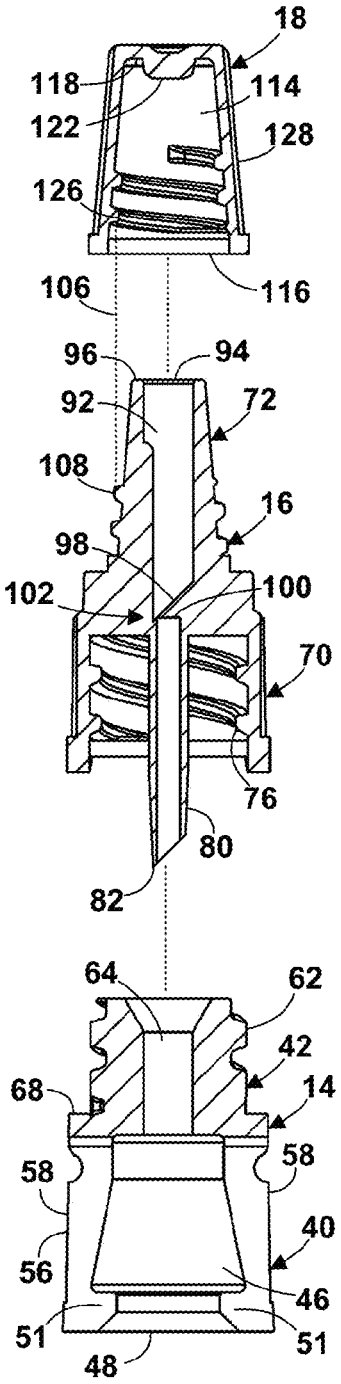
FIG. 7 is a side, cross-sectional, exploded view of the base, piercer, and cap of FIG. 1.
Figure 8:
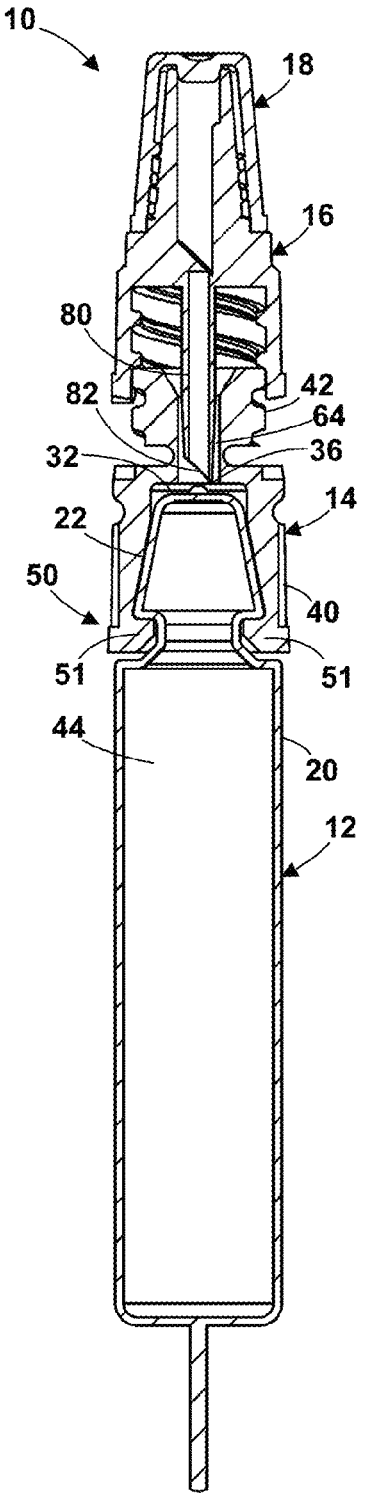
FIG. 8 is a side, cross-sectional view of the container of FIG. 1 before piercing.
Figure 9:
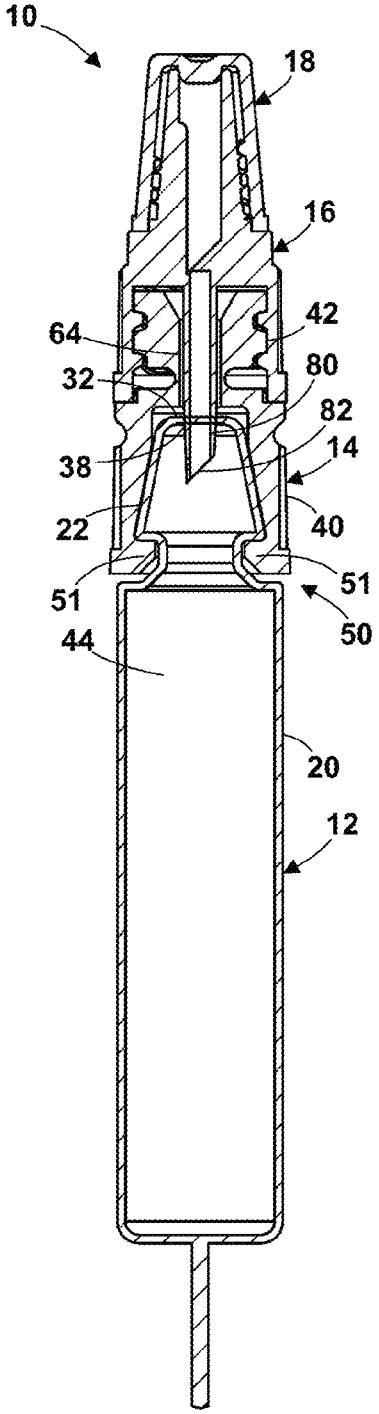
FIG. 9 is a side, cross-sectional view of the container of FIG. 1 after piercing.
Figure 10:
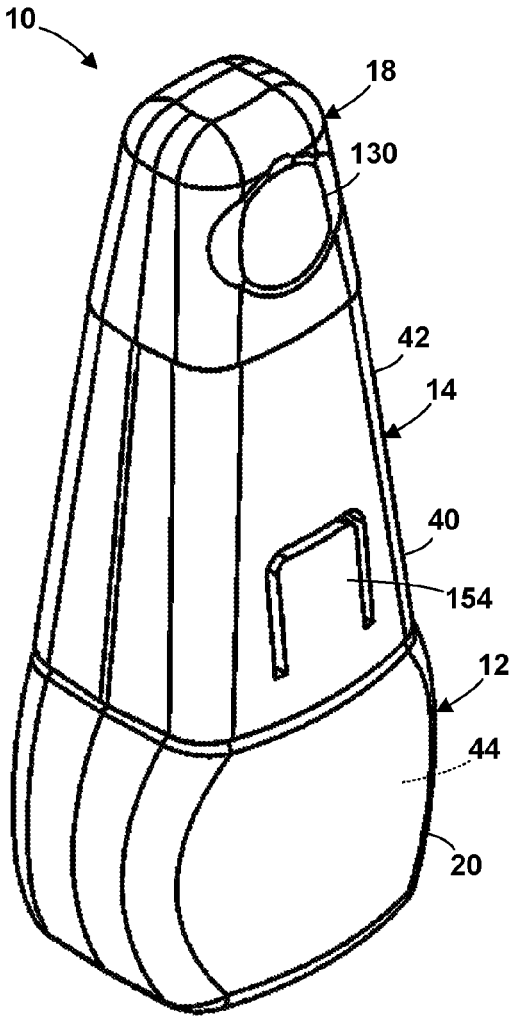
FIG. 10 is a perspective view of another configuration of the container of the present invention.
Figure 11:
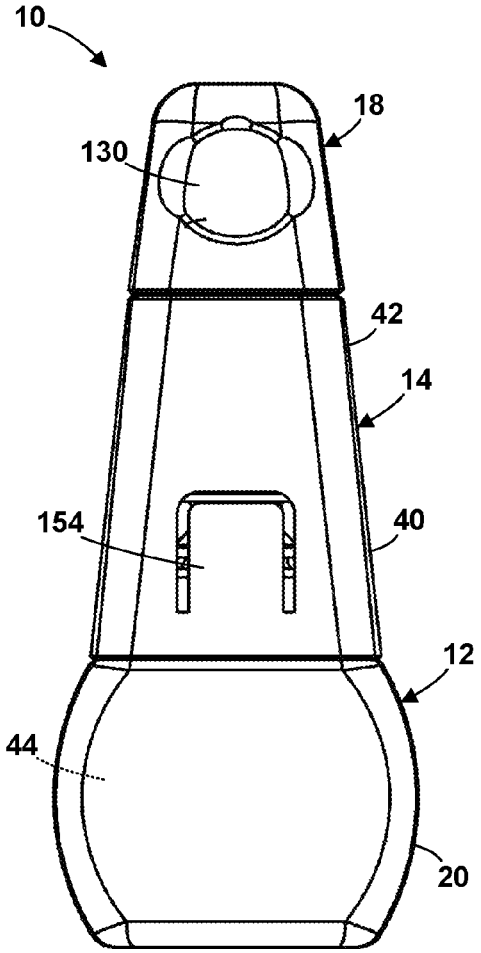
FIG. 11 is a front view of the container of FIG. 10.
Figure 12:
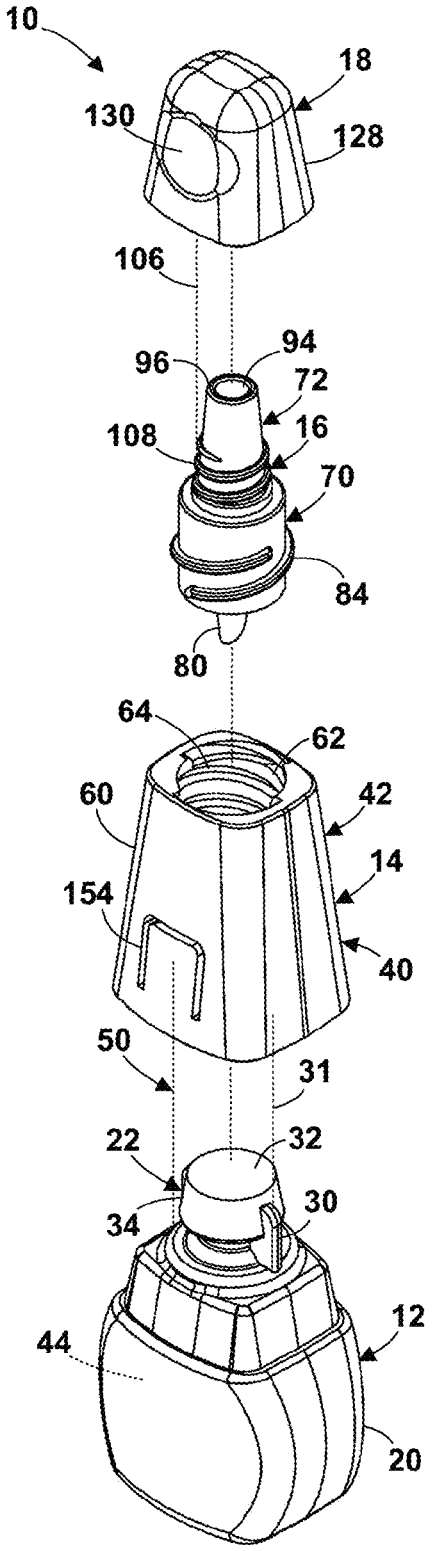
FIG. 12 is exploded, perspective view of the container of FIG. 10.
Figure 13:
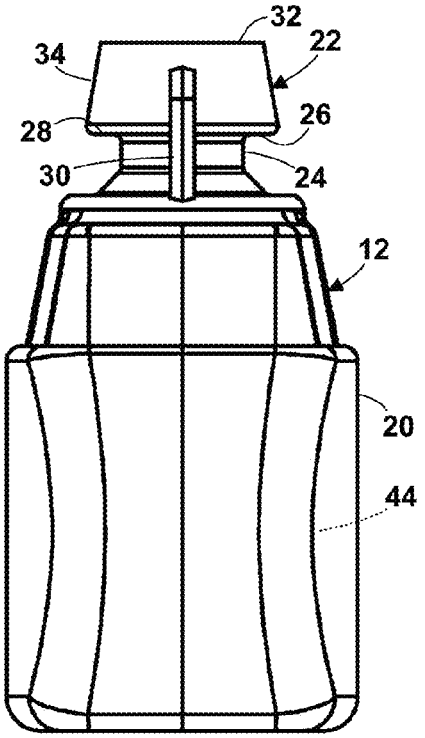
FIG. 13 is a side view of the bottle of FIG. 10.
Figure 14:
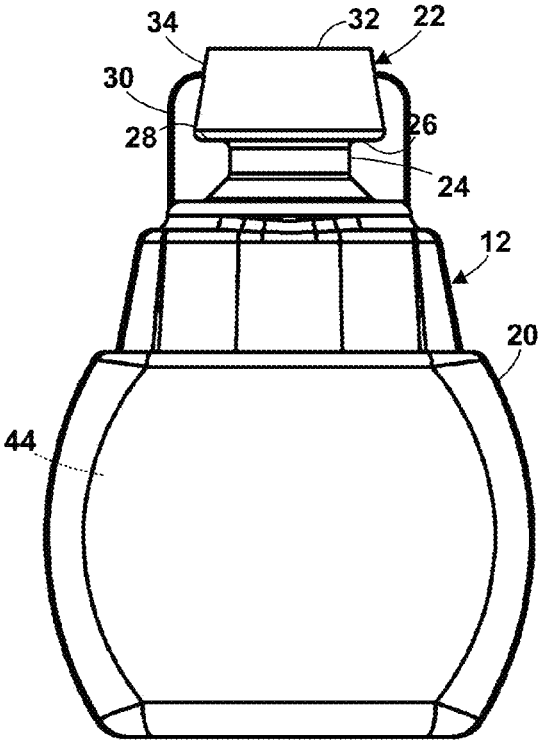
FIG. 14 is a front view of the bottle of FIG. 10.
Figure 15:
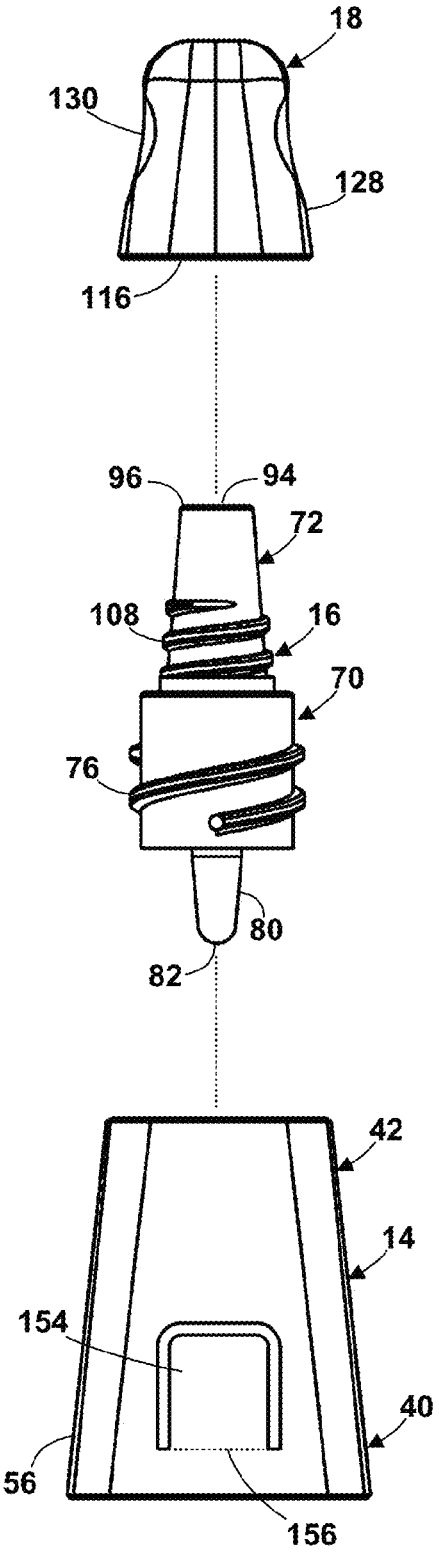
FIG. 15 is a front, exploded view of the base, piercer, and cap of FIG. 10.
Figure 16:
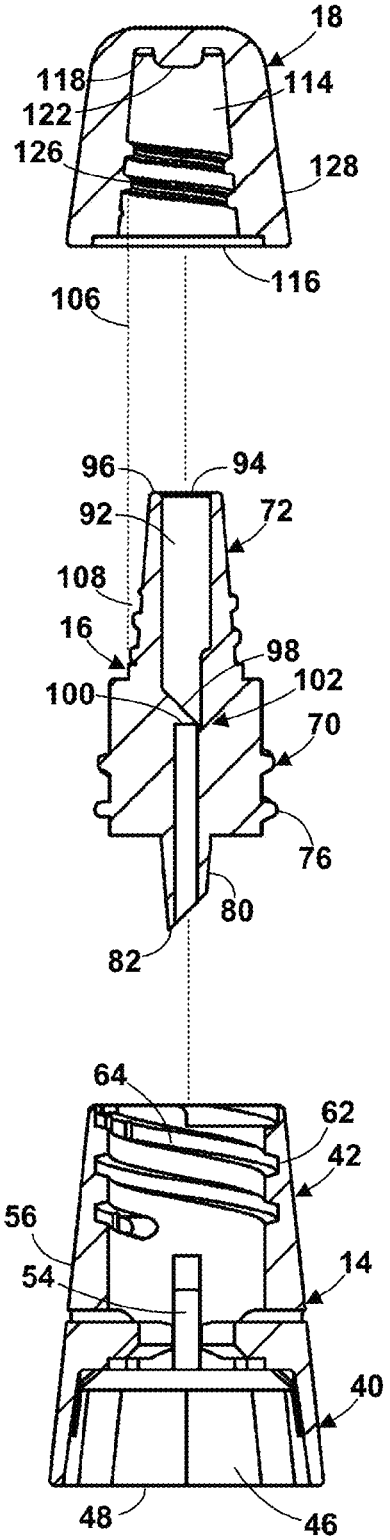
FIG. 16 is a side, cross-sectional, exploded view of the base, piercer, and cap of FIG. 10.

In the configuration of FIGS. 1-9, the base retention mechanism 50 includes a finger 51 extending generally radially into the socket opening 48, as shown in FIG. 7-9. The finger 51 fits under the shoulder 26 of the dispensing head 22 to engage the neck 24, thereby retaining the base 14 on the bottle 12. The height of the socket 46 is generally the same as the height of dispensing head 22 so that, when the base retention mechanism 50 is engaged, the dispensing head 22 does not move axially within the socket 46. The finger 51 holds the base 14 tightly to the dispensing head 22.

Figure 17:
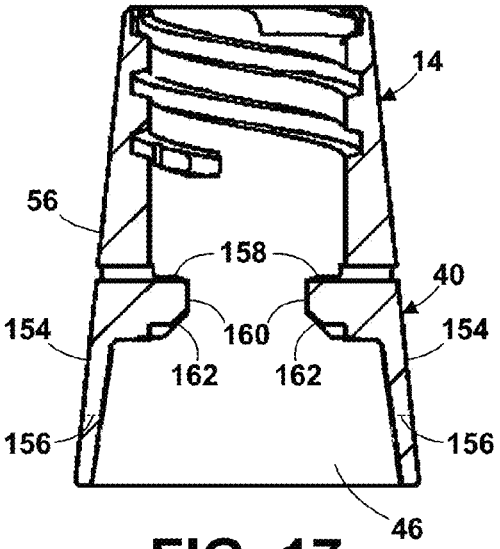
FIG. 17 is a side, cross-sectional view of the base of FIG. 10.
Figure 18:
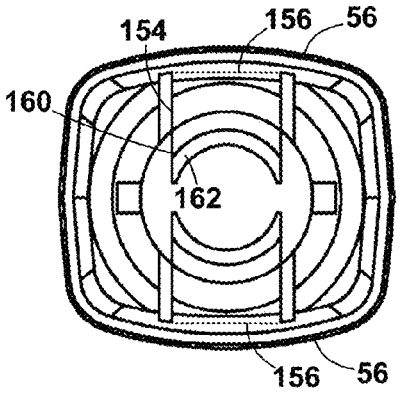
FIG. 18 is a bottom view of the base of FIG. 10.
Figure 19:
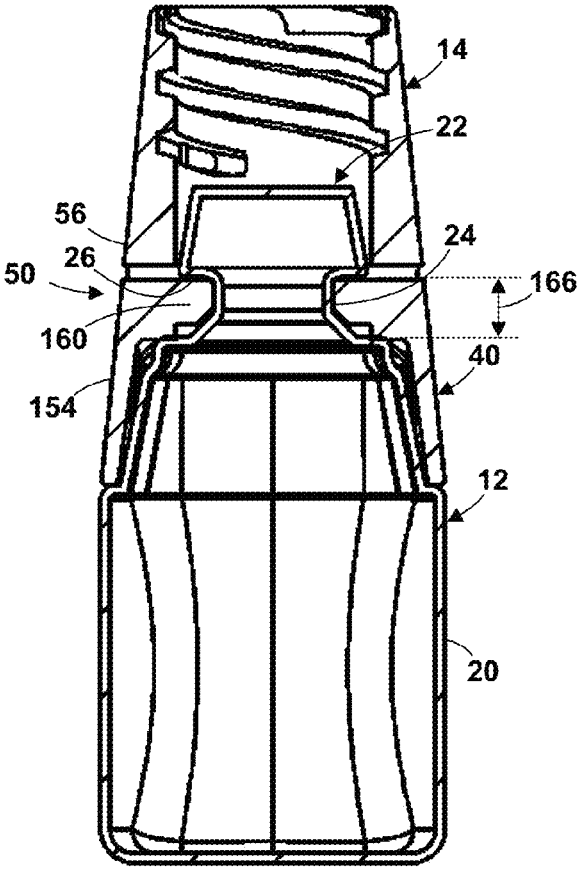
FIG. 19 is a side, cross-sectional view of the base attached to the bottle.
Figure 20:
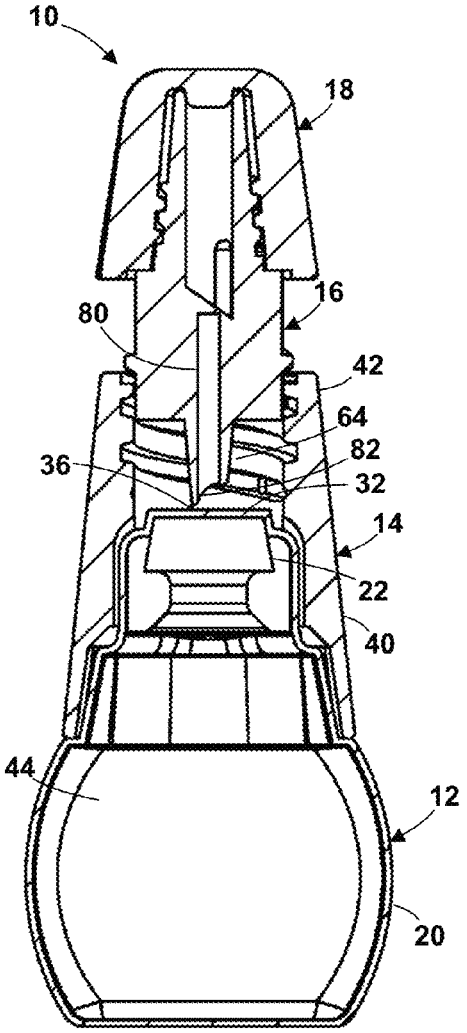
FIG. 20 is a front, cross-sectional view of the container of FIG. 10 before piercing.
Figure 21:
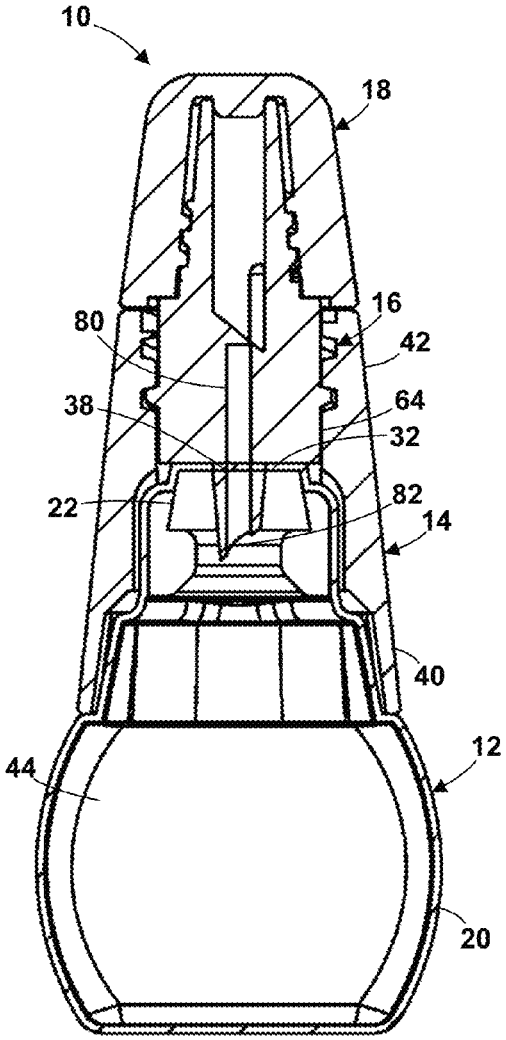
FIG. 21 is a front, cross-sectional view of the container of FIG. 10 after piercing.

In the configuration of FIGS. 10-21, the bottle section wall 56 has opposed tabs 154 that bend outwardly at the bottom attachment 156 of the tab 154 to the wall 56, as shown in FIGS. 17-19. The free 158 end of the tab 154 has a finger 160 extending generally radially into the socket 46. The lower edge of the finger 160 is beveled, as at 162. The finger 160 fits between the shoulder 26 of the dispensing head 22 and the main body 20 to engage the neck 24, thereby retaining the base 14 on the bottle 12. The finger 160 is shaped to fit snuggly at the neck 24 between the main body 20 and dispensing head 22, as at 166, so that, when the base retention mechanism 50 is engaged, the dispensing head 22 does not move axially within the socket 46. The finger 160 holds the base 14 tightly to the dispensing head 22.

Optional radial slots 54 in the wall 56 of the bottle section 40 accept the optional tabs 30 of the bottle dispensing head 22. There is a slot 54 for each tab 30. The tabs 30/slots 54 are a keying mechanism 31 that prevents the base 14 from rotating on the bottle 12. The slots 54 break the wall 56 and finger 51 into wall sections 58 and finger sections 52.

In another keying mechanism 31 that can be employed alternatively or in additional to the tabs 30 and slots 54, the dispensing head 22 and socket 46 can be shaped to prevent the base 14 from rotating on the bottle 12. Any non-round shape will prevent rotation. For example, the dispensing head 22 and socket 46 can be oval or triangular. When the base 14 is installed on the dispensing head 22, the non-round shape prevents the base 14 from rotating on the bottle 12.

The base 14 is installed on the bottle 12 by placing the open end 48 of the base 14 on the dispensing head 22 such that the keying mechanism 31 is aligned, that is, the tabs 30 are aligned with the slots 54 and/or the shape of the dispensing head 22 is appropriately aligned with the shape of the socket 46. The base 14 is pushed axially onto the bottle 12 until the base retention mechanism 50 engages. To engage the base retention mechanism 50, as the base 14 is pushed axially onto the dispensing head 22, the sloped sides 34 of the dispensing head 22 push the fingers 51, 160 outwardly. In the configuration of FIGS. 1-9, the slots 54 help facilitate this process by allowing the wall sections 58 to flex outwardly. To this end, there may be additional slots in the wall 56. In the configuration of FIGS. 10-20, the tabs 154 flex outwardly.

When the fingers 51, 160 reach the shoulder 26, there is no more outward pressure from the dispensing head 22 on the fingers 51, 160. Consequently, the wall 56/tabs 154 snap back to their normal positions with the fingers 51, 160 under the shoulder 26, thereby engaging the base retention mechanism 50.

In one configuration, the finger 51 extends around the entire circumference of the wall 56, broken into finger sections 52 if there are slots 54. In another configuration, each finger section 52 extends over only a short angle of the perimeter rather than the entire perimeter or finger section 52.

Optionally, the outer surface 60 of the bottle section 40 is textured, as at 61, to be easier to grip.

The piercer section 42 has a screw thread 62 that is either external, as in the design of FIGS. 1-9, or internal, as in the design of FIGS. 10-18. The screw thread 62 receives the piercer 16, as described below.

The piercer section 42 has an axial bore 64 that is in communication with the socket 46. The bore 64 receives the piercing tube 78 of the piercer 16, as described below.

The piercer section 42 has a detent depression 65 as part of a piercer locking mechanism 66 for preventing the piercer 16 from being removed from the base 14 after the bottle 12 is pierced. The piercer locking mechanism 66 is described below.

The piercer 16 pierces the bottle 12 and locks onto the base 14 after piercing. It has a base section 70 and a cap section 72. The base section 70 has a screw thread 76 that mates with the piercer section screw thread 62. The base section screw thread 76 is either internal, as in the design of FIGS. 1-9, or external, as in the design of FIGS. 10-18, to mate with the piercer section screw thread 62.

Extending axially through the base section 70 is a hollow piercing tube 80. The piercing tube 80 extends beyond the thread 76 far enough to pierce the piercing wall 32 of the bottle 12, as described below. The tip 82 at the free end of the piercing tube 80 is sharpened so that it can pierce the piercing wall 32. Typically, the tip 82 is sharpened by terminating the tube 80 at a slant that is between 30° and 60°, preferably approximately 45°. Alternatively, the tip 82 is sharpened by terminating the tube 80 in a V. Alternatively, the tip 82 is sharpened by terminating the tube 80 with a serrated edge.

The base section 70 has a detent protrusion 84 that mates with the detent depression 65 of the base 14. The combination of detent depression 65 and detent protrusion 84 form the piercer locking mechanism 66.

The piercer 16 is installed on the base 14 by turning the piercer base section thread 76 onto (for an internal piercer thread) or into (for an external piercer thread) the base piercer section thread 62. In the shipping mode, the piercer 16 is turned onto the base 14 until the piercing tube tip 82 is adjacent to (touching or nearly touching) the piercing wall 32, as at 36 in FIGS. 8 and 17. Prior to use, the container 10 is put into the use mode. To do so, the piercer 16 is turned onto the base 14 until the piercing tube tip 82 has penetrated the piercing wall 32 and extends into the fluid chamber 44, as at 38 in FIGS. 9 and 21, and the piercer 16 can no longer turn. At this point, the piercer 16 is fully turned onto the base 14 and the detent protrusion 84 snaps into the detent depression 65 to engage the piercer locking mechanism 66. Once engaged, the piercer locking mechanism 66 makes it difficult to manually turn the piercer 16 back off the base 14. The material of which the base 14 and piercer 16 are composed have a small amount of resiliency to allow the protrusion 84 to snap into the depression 65.

The piercer locking mechanism 66 can take any form that is appropriate, many forms of which are known in the art. In the present design, the detent depression 65 is a semi-cylindrical, radial notch in the upper edge 68 of the bottle section 40. The detent protrusion 84 is a matching semi-cylindrical, radial finger on the lower edge 86 of the base section 70. In another form of piercer locking mechanism 66, the depression 65 and protrusion 84 are saw-tooth-shaped such that, when engaged, the flat surfaces abut each other to prevent reverse rotation of the piercer 16.

Alternatively, the depression and protrusion are reversed, that is, the depression is onto piercer 16 and the protrusion is on the base 14.

Other variations of the piercer locking mechanism 66 are contemplated by the present invention, including a finger/shoulder mechanism similar to that described above with reference to the base 14 attachment to the bottle 12.

Optionally, the outer surface 88 of the base section 70 is textured, as at 90, to be easier to grip.

The cap section 72 has an axial dispensing bore 92 with an opening 94 in the end surface 96 of the cap section 72.

The internal end 98 of the dispensing bore 92 interfaces with the internal end 100 of the piercing tube 80, as at 102, to provide drop control, as is well-known in the art. Briefly, the difference in diameter between the piercing tube 80 and dispensing bore 92 and the surface area of the interface 102 regulates how much and how fast liquid is expelled from the bottle 12. The interface 102 can be configured to dispense a metered drop or stream of fluid. The diameter of the dispensing bore 92 determines the size of the metered drop at the dispensing bore opening 94.

The cap section 72 includes a mechanism 106 for removably attaching the cap 18. In the designs of FIGS. 1-9 and 10-18, the cap 18 is removably attached by an external screw thread 108.

The cap 18 closes the dispensing bore opening 94. The cap 18 is cup-shaped, as at 114. It is open at one end, as at 116, and closed at that other end, as at 118.

Optionally, the cap 18 has a plug 122 inside the closed end 118. The plug 122 is designed to fit snuggly into the dispensing bore opening 94 as a stopper.

In the present design, the hollow 114 has an internal thread 126 that turns onto the piercer external thread 108. The cap 18 can be used to help drive the piercer 16 when initially piercing the bottle 12.

Optionally, the outer surface 128 of the cap 18 is textured, as at 130. The texturing 130 can take any form desired, including knurling, finger depressions, or other features known in the art to be easier to grip when turning.

Figure 22:
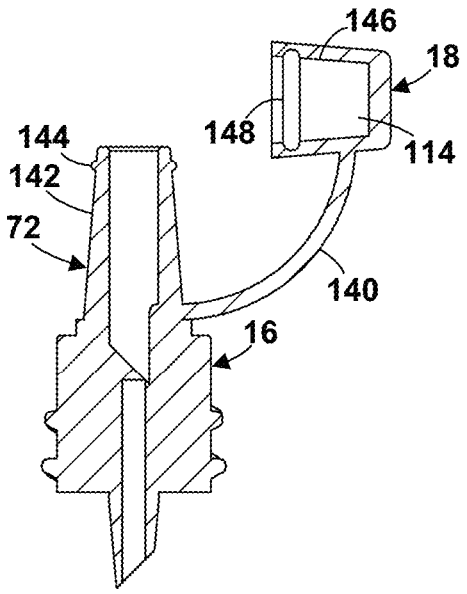
FIG. 22 is a side, cross-sectional view of a snap-on cap in the open position.
Figure 23:
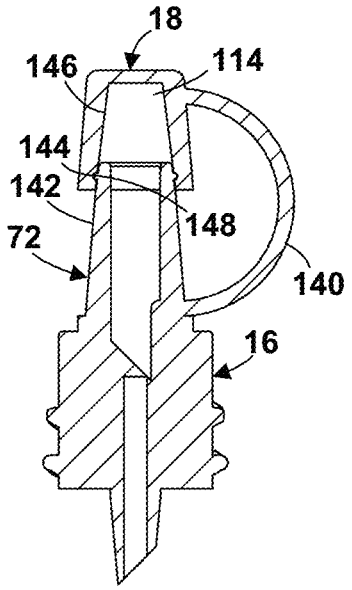
FIG. 23 is a side, cross-sectional view of a snap-on cap in the closed position.

Alternatively, the cap 18 is removably attached by a snap mechanism, as in FIGS. 22 and 23. The cap 18 is permanently attached to the piercer 16 by a flexible strip 140. The outer surface 142 of the cap section 72 has an annular rounded protrusion 144. The inside surface 146 of the cap hollow 114 has an annular rounded depression 148. As the cap 18 is pushed onto the piercer 16, the annular depression 148 snaps over the annular protrusion 144.

The base 14, piercer 16, and cap 18 are injection molded using a relatively rigid plastic material. Examples include acrylonitrile butadiene styrene (ABS), polypropylene, polyoxymethylene (POM), styrene, and similar materials.

Thus it has been shown and described a delayed-pierce, sealed container. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A sealed, delayed-pierce container comprising:

(a) a sealed bottle having a main body, a dispensing head attached to the main body by a neck, and a fluid chamber extending between the main body, neck, and dispensing head, the dispensing head having a piercing wall opposite the neck;

(b) a base having a bottle section and a piercer section, the bottle section having a wall and a socket shaped to accept the dispensing head, the piercer section having an axial bore in communication with the socket;

(c) a piercer having a base section and a cap section, the base section having a screw thread to mate with a corresponding screw thread on the base piercer section for turning the piercer onto the base, the piercing section having an axial piercing tube with a tip extending into the piercer section bore and an internal end interfacing with an axial dispensing bore in the cap section;

(d) a cap;

(e) a base retention mechanism for retaining the base on the bottle;

(f) a piercer locking mechanism for retaining the piercer on the base; and (g) a cap retention mechanism for removably retaining the cap on the piercer;

(h) the container having a shipping mode wherein the piercer is turned onto the base until the piercing tube tip is adjacent to the piercing wall, and a use mode wherein the piercer is turned onto the base until the piercing tube tip pierces the piercing wall and extends into the fluid chamber and the piercer locking mechanism engages to make it difficult to manually turn the piercer off the base.

2. The container of claim 1 wherein the base retention mechanism includes at least one finger extending from the bottle section wall into the socket and engaging the bottle at the neck.

3. The container of claim 1 further comprising a keying mechanism to prevent the base from rotating on the bottle.

4. The container of claim 3 wherein the keying mechanism includes at least one tab extending radially from the bottle and a corresponding slot in the base bottle section.

5. The container of claim 3 wherein the keying mechanism includes the dispensing head having a non-round shape and the base bottle section socket having a matching shape.

6. The container of claim 1 wherein the piercer locking mechanism includes a detent mechanism on the base and the piercer that engages when the piercer is fully turned onto the base.

7. The container of claim 1 wherein the base piercer section screw threads are external and the piercer base section screw threads are internal.

8. The container of claim 1 wherein the base piercer section screw threads are internal and the piercer base section screw threads are external.

9. The container of claim 1 wherein the piercing tube tip is sharpened.

10. The container of claim 1 wherein the cap has a plug to fill the dispensing bore opening when the cap retention mechanism is engaged.

11. The container of claim 1 wherein the cap retention mechanism includes external screw threads on the piercer cap section and mating internal screw threads in the cap.

12. The container of claim 1 wherein the piercing base section is textured for gripping.

13. The container of claim 1 wherein the cap is textured for gripping.

14. A sealed, delayed-pierce container comprising:

(a) a sealed bottle having a main body, a dispensing head attached to the main body by a neck, and a fluid chamber extending between the main body, neck, and dispensing head, the dispensing head having a piercing wall opposite the neck;

(b) a base having a bottle section and a piercer section, the bottle section having a wall, a socket shaped to accept the dispensing head, and at least one finger extending from the bottle section wall into the socket and engaging the bottle at the neck to retain the base on the bottle, the piercer section having an axial bore in communication with the socket;

(c) a piercer having a base section and a cap section, the base section having a screw thread to mate with a corresponding screw thread on the base piercer section for turning the piercer onto the base, the piercing section having an axial piercing tube with a sharpened tip extending into the piercer section bore and an internal end interfacing with an axial dispensing bore in the cap section;

(d) a cap;

(e) a keying mechanism to prevent the base from rotating on the bottle;

(f) a piercer locking mechanism including a detent mechanism on the base and the piercer that engages when the piercer is fully turned onto the base to retain the piercer on the base; and (g) a cap retention mechanism including external screw threads on the piercer cap section and mating internal screw threads in the cap to removably retain the cap on the piercer cap section;

(h) a plug in the cap to fill the dispensing bore opening when the cap retention mechanism is engaged;

(i) the container having a shipping mode wherein the piercer is turned onto the base until the piercing tube tip is adjacent to the piercing wall, and a use mode wherein the piercer is turned onto the base until the piercing tube tip pierces the piercing wall and extends into the fluid chamber and the piercer locking mechanism engages to make it difficult to manually turn the piercer off the base.

15. The container of claim 14 wherein the keying mechanism includes at least one tab extending radially from the bottle and a corresponding slot in the base bottle section.

16. The container of claim 14 wherein the keying mechanism includes the dispensing head having a non-round shape and the base bottle section socket having a matching shape.

17. The container of claim 14 wherein the base piercer section screw threads are external and the piercer base section screw threads are internal.

18. The container of claim 14 wherein the base piercer section screw threads are internal and the piercer base section screw threads are external.

19. The container of claim 14 wherein the piercing base section is textured for gripping.

20. The container of claim 14 wherein the cap is textured for gripping.

* * * * *